US011965272B2

(12) United States Patent
Enqvist

(10) Patent No.: US 11,965,272 B2
(45) Date of Patent: Apr. 23, 2024

(54) INDUSTRIAL TEXTILE

(71) Applicant: Valmet Technologies, Inc., Espoo (FI)

(72) Inventor: Rauno Enqvist, Tampere (FI)

(73) Assignee: Valmet Technologies, Inc., Espoo (FI)

( * ) Notice: Subject to any disclaimer, the term of this patent is extended or adjusted under 35 U.S.C. 154(b) by 81 days.

(21) Appl. No.: 17/959,094

(22) Filed: Oct. 3, 2022

(65) Prior Publication Data

US 2023/0105047 A1 Apr. 6, 2023

(30) Foreign Application Priority Data

Oct. 6, 2021 (FI) ..... 20216031

(51) Int. Cl.

| | |
|---|---|
| ***D03D 11/00*** | (2006.01) |
| ***D03D 13/00*** | (2006.01) |
| ***D03D 15/283*** | (2021.01) |
| ***D03D 15/43*** | (2021.01) |
| ***D03D 15/587*** | (2021.01) |

(52) U.S. Cl.

CPC ..... *D03D 13/004* (2013.01); *D03D 15/283* (2021.01); *D03D 15/43* (2021.01); *D03D 15/587* (2021.01); *D10B 2505/00* (2013.01); *D10B 2505/04* (2013.01)

(58) Field of Classification Search

CPC .... D03D 13/004; D03D 15/283; D03D 15/43; D03D 15/587; D03D 1/0094; D03D 3/04; D03D 13/00; D10B 2505/00; D10B 2505/04; D21F 1/0036; D21F 7/083

See application file for complete search history.

(56) References Cited

U.S. PATENT DOCUMENTS 3,207,659 A * 9/1965 Wagner ..... D21F 1/0027 28/142
5,169,709 A * 12/1992 Fleischer ..... D21F 1/0036 162/348
5,422,166 A * 6/1995 Fleischer ..... D21F 1/0027 428/196
5,795,835 A * 8/1998 Bruner ..... E02B 3/04 442/310

(Continued)

FOREIGN PATENT DOCUMENTS

EP 3601665 B1 12/2020

OTHER PUBLICATIONS

American Heritage® Dictionary of the English Language, Fifth Edition. S.v. "bond." Retrieved Feb. 12, 2024 from https://www.thefreedictionary.com/bond (Year: 2016).*

*Primary Examiner* — Robert H Muromoto, Jr.
(74) *Attorney, Agent, or Firm* — Stiennon & Stiennon

(57) ABSTRACT

An industrial textile has a double warp. Yarns (111, 112) of a first warp and yarns (131, 132, 133, 134) of a weft are bonded to each other according to a first predetermined pattern, and yarns (121, 122) of a second warp and the yarns (131, 132, 133, 134) of the weft are bonded to each other according to a second predetermined pattern. The first predetermined pattern and the second predetermined pattern form a textile structure, which includes the yarns (131, 132) of the weft on a first level (L1) and the yarns (133, 134) of the weft on a second level (L2). The yarns of the weft having smaller diameter are configured to alternate with yarns of the weft having a larger diameter on the first level (L1).

19 Claims, 4 Drawing Sheets

(56) References Cited

U.S. PATENT DOCUMENTS

| | | | | |
|---|---|---|---|---|
| 6,284,678 | B1 * | 9/2001 | Kobayashi | D03D 11/00 139/411 |
| 7,896,035 | B2 * | 3/2011 | Ueda | D21F 1/0036 139/383 R |
| 8,961,742 | B2 * | 2/2015 | Hedou | D21F 7/083 162/900 |
| 2010/0119787 | A1 * | 5/2010 | Ueda | D21F 1/0036 428/196 |
| 2010/0288459 | A1 * | 11/2010 | Ito | D21F 7/083 425/363 |
| 2013/0020043 | A1 * | 1/2013 | Hedou | D21F 7/08 162/358.2 |
| 2018/0347114 | A1 * | 12/2018 | Despault | D21F 7/083 |

* cited by examiner

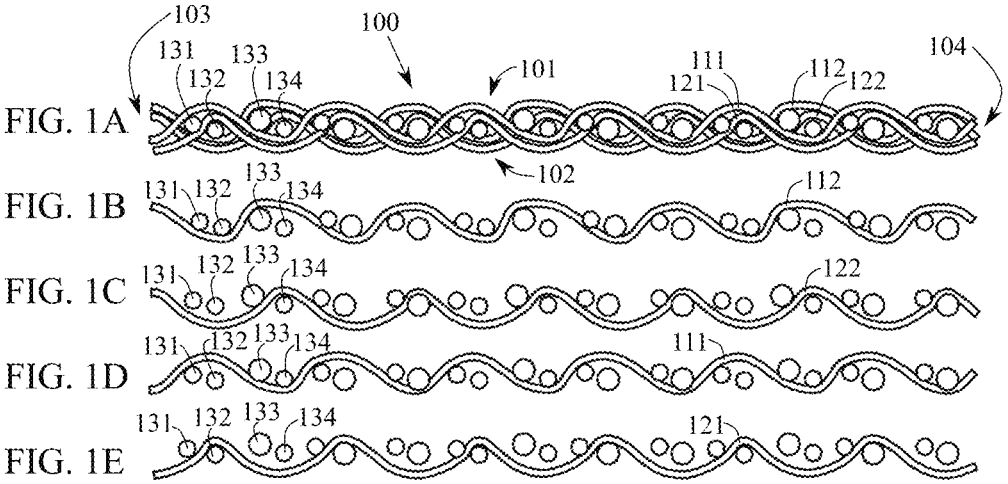
FIG. 1A
FIG. 1B
FIG. 1C
FIG. 1D
FIG. 1E
103
100
101
102
104
111
112
121
122
131
132
133
134
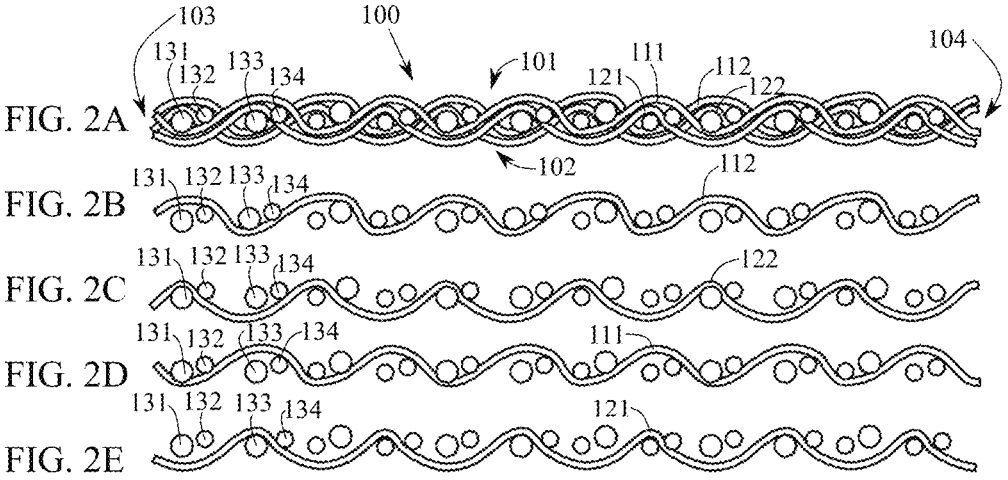
FIG. 2A
FIG. 2B
FIG. 2C
FIG. 2D
FIG. 2E
103
100
101
102
104
111
112
121
122
131
132
133
134

FIG. 3A

| | | | | | | | | |
|---|---|---|---|---|---|---|---|---|
| L1 | O | | o | | O | | o | |
| L2 | | O | | o | | O | | o |

FIG. 3B

| | | | | | | | | |
|---|---|---|---|---|---|---|---|---|
| L1 | O | | o | | O | | o | |
| L2 | | o | | O | | o | | O |

FIG. 3C

| | | | | | | | | |
|---|---|---|---|---|---|---|---|---|
| L1 | O | | o | | O | | o | |
| L2 | | o | | o | | o | | o |

FIG. 3D

| | | | | | | | | | | | | |
|---|---|---|---|---|---|---|---|---|---|---|---|---|
| L1 | O | | o | | o | | O | | o | | o | |
| L2 | | o | | O | | o | | o | | O | | o |

FIG. 3E

| | | | | | | | | | | | | |
|---|---|---|---|---|---|---|---|---|---|---|---|---|
| L1 | O | | o | | o | | O | | o | | o | |
| L2 | | O | | o | | o | | O | | o | | o |

FIG. 3F

| | | | | | | | | | | | | | | | | |
|---|---|---|---|---|---|---|---|---|---|---|---|---|---|---|---|---|
| L1 | O | | o | | o | | o | | O | | o | | o | | o | |
| L2 | | o | | O | | O | | o | | o | | O | | O | | o |

FIG. 3G

| | | | | | | | | | | | | | | | | |
|---|---|---|---|---|---|---|---|---|---|---|---|---|---|---|---|---|
| L1 | O | | o | | O | | o | | O | | o | | O | | o | |
| L2 | | o | | O | | o | | o | | o | | O | | o | | o |

INDUSTRIAL TEXTILE

CROSS REFERENCES TO RELATED APPLICATIONS

This application claims priority on Finnish Application No. 20216031, filed Oct. 6, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to industrial textiles, particularly industrial textiles used as conveyor fabrics, dryer fabrics or filter fabrics.

A conveyor fabric can be used to transport paper mass, paper web or board web to a pulper or cake to a cellulose dryer. The conveyor fabric has a first surface and a second surface. The first surface is in contact with paper mass or cake, when the conveyor fabric is assembled to a conveyor. The second surface is in contact with a conveyor equipment when the conveyor fabric is assembled to the conveyor. The first side should have a coarse surface texture to provide high friction and grip for carrying paper mass or cake also upward. The second side should have a relative smooth surface to provide good wear resistance and performance. When extra grip is needed, the conveyor fabric can be equipped with silicon stripes. The silicon stripes are formed in a cross-machine direction of the conveyor fabric.

However, the silicon stripe treatment is very time consuming. First, it bonds the labor force for hours for making silicon stripes. Secondly, drying of the silicon stripes takes several hours. In addition, when the fabric is drying, it takes up a lot of floor space for several hours.

EP3601665 B1 discloses an industrial textile having a granular texture on the first surface. However, the industrial textile has a substantially even surface topography with relatively small waviness. The industrial textile has relatively high contact surface area. Thus, material, such as dirt, on the first surface does not easily stick to the surface.

Therefore, there is need for improving industrial textiles, particularly developing alternatives to the silicone stripes.

SUMMARY OF THE INVENTION

According to a first aspect of the present invention, there is provided an industrial textile having a machine direction and a cross-machine direction, and a first surface and a second surface, the industrial textile comprising a double warp comprising a first warp comprising first machine direction yarns, and a second warp comprising second machine direction yarns, the yarns of the first warp being arranged above the yarns of the second warp, a weft comprising cross-machine direction yarns, the yarns of the first warp and the yarns of the weft being bonded to each other according to a first predetermined pattern, the yarns of the second warp and the yarns of the weft being bonded to each other according to a second predetermined pattern, and the first predetermined pattern and the second predetermined pattern forming a textile structure, which comprises the yarns of the weft on a first level and the yarns of the weft on a second level in a thickness direction of the industrial textile, wherein yarns of the weft having smaller diameter are configured to alternate with yarns of the weft having larger diameter on the first level.

According to an embodiment, every second, third or fourth yarn of the weft on the first level has a larger diameter than the other yarns of the weft on the first level.

According to an embodiment, the yarns of the weft having a smaller diameter are configured to alternate with the yarns of the weft having a larger diameter on the second level.

According to an embodiment, the industrial textile has one yarn of the weft having a larger diameter and one yarn of the weft having a smaller diameter in a pattern repeat on the first level, and one yarn of the weft having a larger diameter and one yarn of the weft having a smaller diameter in a pattern repeat on the second level, one yarn of the weft having a smaller diameter and one yarn of the weft having a larger diameter in a pattern repeat on the second level, or every yarn of the weft on the second level has the same diameter, which diameter is smaller than the diameter of the larger yarns of the wefts on the first level.

According to an embodiment, the industrial textile has one yarn of the weft having a larger diameter and two yarns of the weft having a smaller diameter in a pattern repeat on the first level, and one yarn of the weft having a smaller diameter, one yarn of the weft having a larger diameter and one yarn of the weft having a smaller diameter in a pattern repeat on the second level, or one yarn of the weft having a larger diameter and two yarns of the wefts having a smaller diameter in a pattern repeat on the second level.

According to an embodiment, the industrial textile has one yarn of the weft having a larger diameter and three yarns of the weft having a smaller diameter in a pattern repeat on the first level, and one yarn of the weft having a smaller diameter, two yarns of the wefts having a larger diameter and one yarn of the weft having a smaller diameter in a pattern repeat on the second level.

According to an embodiment, the industrial textile has one yarn of the weft having a larger diameter and one yarn of the weft having a smaller diameter in a pattern repeat on the first level, and one yarn of the weft having a smaller diameter, one yarn of the weft having a larger diameter and two yarns of the weft having smaller diameters in a pattern repeat on the second level.

According to an embodiment, the diameters of the yarns of the weft having a larger diameter are 0.2 mm greater than the diameters of the yarns of the weft having smaller diameters.

According to an embodiment, in the first predetermined pattern, the yarns of the first warp are configured to bind the yarns of the weft under two and over two yarns of the weft.

According to an embodiment, in the second predetermined pattern, the yarns of the second warp are configured to bond the yarns of the weft under three yarns and over one yarn of the weft.

According to an embodiment, the yarns of the first warp next to each other are arranged in such a manner that when a coincidentally selected warp yarn is under the weft yarns, the warp yarn next to the coincidentally selected warp yarn is above the weft yarn.

According to an embodiment, the yarns of the second warp next to each other are arranged in such a manner that when a coincidentally selected warp yarn is under the weft yarn, the warp yarn next to the coincidentally selected warp yarn is above the weft yarn.

According to an embodiment, a coincidentally selected yarn of the first warp and the yarn of the second warp are arranged in such a manner that when the yarn of the first warp binds the yarns of the weft under two, the yarn of the second warp binds the yarns of the weft under two, and a yarn of the first warp next to the coincidentally selected warp yarn of the first warp and a yarn of the second warp next to the coincidentally selected warp yarn are arranged in such manner that when the yarn of the first warp binds the yarns of the weft over two, the yarn of the second warp binds the yarns of the weft over one and under one.

According to an embodiment, the industrial textile has a contact area under 20%.

According to an embodiment, said contact area being measured by a method comprising providing a sample of the industrial textile having a length of 130 mm in the machine direction and a width of 20 mm in the cross-machine direction, polishing the paper-side of the sample by removing 0.12 mm in a thickness direction of the sample, photographing the sample by a microscope camera, calibrating magnification by a calibration ruler, imaging the calibration ruler and the polished surface of the sample with the calibrated magnification, and measuring the percentage of the contact area by an image processing software.

According to an embodiment, the industrial textile comprises a first edge and a second edge, which first edge and second edge are configured to be connected together by a seam element, which comprises a first part connected to the first edge and a second part connected to the second edge.

According to an embodiment, inner surfaces of the first part and inner surfaces of the second part of the seam element are shaped to correspond to a surface texture of the industrial textile.

According to an embodiment, the inner surfaces of the first part and the inner surfaces of the second part of the seam element comprise teeth configured to be attached to the industrial textile.

According to a second aspect of the present invention, there is provided use of an industrial textile as a conveyor fabric, a dryer fabric or a filter fabric.

BRIEF DESCRIPTION OF THE DRAWINGS

FIG. 1A illustrates a cross section of an industrial textile in a machine direction in accordance with at least some embodiments of the present invention.

FIG. 1B illustrates a cross section of yarns of a weft and a yarn of a first warp in a machine direction in accordance with at least some embodiments of the present invention.

FIG. 1C illustrates a cross section of yarns of a weft and a yarn of a second warp in a machine direction in accordance with at least some embodiments of the present invention.

FIG. 1D illustrates a cross section of yarns of a weft and a yarn of a first warp in a machine direction in accordance with at least some embodiments of the present invention.

FIG. 1E illustrates a cross section of yarns of a weft and a yarn of a second warp in a machine direction in accordance with at least some embodiments of the present invention.

FIG. 2A illustrates a cross section of an industrial textile in a machine direction in accordance with at least some embodiments of the present invention.

FIG. 2B illustrates a cross section of yarns of a weft and a yarn of a first warp in a machine direction in accordance with at least some embodiments of the present invention.

FIG. 2C illustrates a cross section of yarns of a weft and a yarn of a second warp in a machine direction in accordance with at least some embodiments of the present invention.

FIG. 2D illustrates a cross section of yarns of a weft and a yarn of a first warp in a machine direction in accordance with at least some embodiments of the present invention.

FIG. 2E illustrates a cross section of yarns of a weft and a yarn of a second warp in a machine direction in accordance with at least some embodiments of the present invention.

FIG. 3A illustrates that every second yarn of a weft on a first level has a larger diameter than other yarns of the weft on the first level in accordance with at least some embodiments of the present invention.

FIG. 3B illustrates that every second yarn of a weft on a first level has a larger diameter than other yarns of the weft on the first level in accordance with at least some embodiments of the present invention.

FIG. 3C illustrates that every second yarn of a weft on a first level has a larger diameter than other yarns of the weft on the first level in accordance with at least some embodiments of the present invention.

FIG. 3D illustrates that every third yarn of a weft on a first level has a larger diameter than other yarns of the weft on the first level in accordance with at least some embodiments of the present invention.

FIG. 3E illustrates that every third yarn of a weft on a first level has a larger diameter than other yarns of the weft on the first level in accordance with at least some embodiments of the present invention.

FIG. 3F illustrates that every fourth yarn of a weft on a first level has a larger diameter than other yarns of the weft on the first level in accordance with at least some embodiments of the present invention.

FIG. 3G illustrates that every second yarn of a weft on a first level has a larger diameter than other yarns of the weft on the first level in accordance with at least some embodiments of the present invention.

DESCRIPTION OF THE PREFERRED EMBODIMENTS

Figure 4:
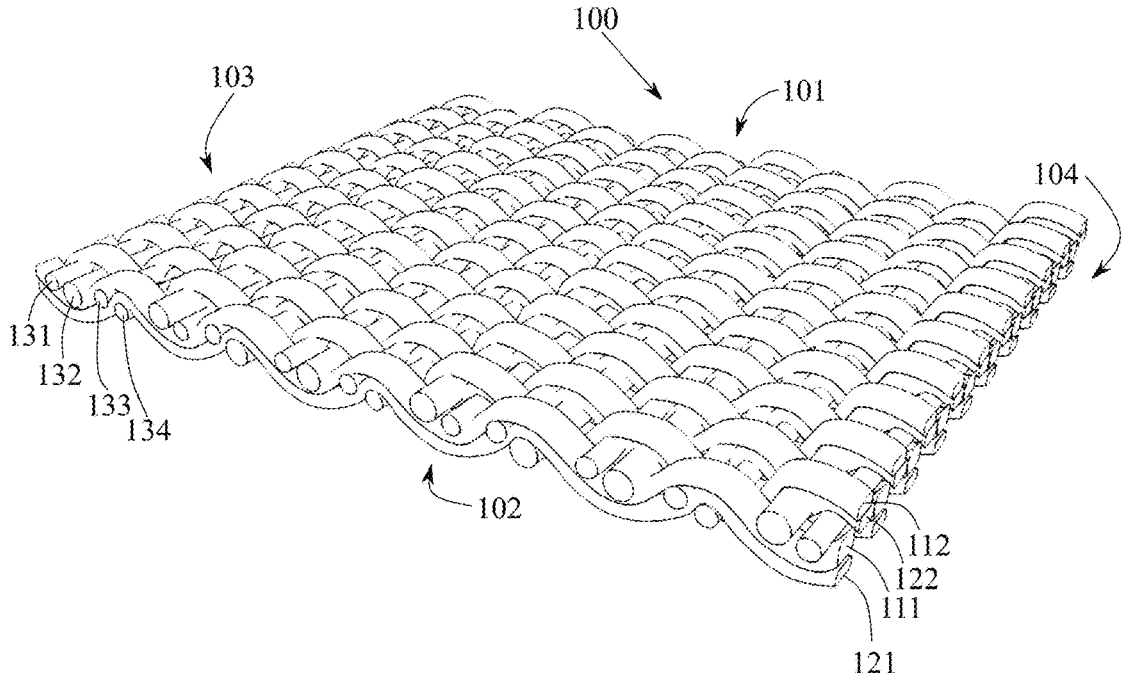
FIG. 4 illustrates a surface view of an industrial textile in accordance with at least some embodiments of the present invention.

In the present context, the term "first side" refers to a side of an industrial textile, which side is in contact with a paper mass or cake, when the industrial fabric is assembled to a conveyor.

In the present context, the term "second side" refers to a side of an industrial textile, which side is in contact with a conveyor equipment, when the industrial fabric is assembled to the conveyor.

In the present context, the term "machine direction" refers to a moving direction or a first direction of the industrial textile in the paper, board or tissue machine when the textile is assembled to the paper, board or tissue machine.

In the present context, the term "cross-machine direction" refers to a direction which is perpendicular to the moving direction or the first direction of the industrial textile in the paper, board or tissue machine when the textile is assembled to the paper, board or tissue machine.

When extra grip is needed, the conveyor fabric can be equipped with silicon stripes. The silicon stripe treatment is very time consuming and binds labor force. At least some of the present embodiments solve the abovementioned problems.

According to an embodiment, the industrial textile 100 has a machine direction (MD) and a cross-machine direction (CMD), and a first surface 101 and a second surface 102. The industrial textile comprises a double warp comprising a first warp comprising first machine direction yarns 111, 112, and a second warp comprising second machine direction yarns 121, 122. The yarns 111, 112 of the first warp are arranged above the yarns 121, 122 of the second warp. The industrial textile further comprises a weft comprising cross-machine direction yarns 131, 132, 133, 134. The double warp comprising the overlapping warp yarns makes the textile strong and resistant against wear. The yarns 111, 112 of the first warp and the yarns 131, 132, 133, 134 of the weft are bonded to each other according to a first predetermined pattern. The yarns 121, 122 of the second warp and the yarns 131, 132, 133, 134 of the weft are bonded to each other according to a second predetermined pattern. The first predetermined pattern and the second predetermined pattern form a textile structure, which comprises the cross-machine direction yarns on a first level and the cross-machine direction yarns on a second level in a thickness direction of the industrial textile 100. Yarns of the weft having a smaller diameter are configured to alternate with yarns of the weft having a larger diameter on the first level. This enables a coarse textured structure on the first side of the industrial textile. Higher peaks and lower valleys are formed in the industrial textile in a thickness direction of the industrial textile. The coarse structure provides more friction and grip to carry paper mass or cake. Thanks to the coarse structure, paper mass or cake can be also carried upwards. In addition, a time-consuming silicon stripe treatment can be avoided.

The industrial textile 100 comprises a first edge 103 and a second edge 104. The first edge 103 and the second edge 104 can be connected together to form a loop.

According to an embodiment, in the first predetermined pattern, the yarns 111, 112 of the first warp are configured to bind the yarns 131, 132, 133, 134 of the weft under two 131, 132 and over two yarns 133, 134 of the weft.

According to an embodiment, in the second predetermined pattern, the yarns 121, 122 of the second warp are configured to bond the yarns 131, 132, 133, 134 of the weft under three yarns 131, 132, 134 and over one yarn 133 of the weft.

FIG. 1A illustrates a cross section of an industrial textile 100 in a machine direction in accordance with at least some embodiments. The industrial textile 100 comprises the yarns 111, 112 of the first warp, the yarns 121, 122 of the second warp and the yarns 131, 132, 133, 134 of the weft. The yarns 111, 112 of the first warp are arranged above the yarns 121, 122 of the second warp. The yarn 111 of the first warp and the yarn 121 of the second warp are configured to form a first row of the industrial textile 100, and the yarn 112 of the first warp and the yarn 122 of the second warp are configured to form a second row of the industrial textile 100.

FIG. 1B illustrates a cross section of the yarns 131, 132, 133, 134 of the weft and the yarn 112 of the first warp in a machine direction in accordance with at least some embodiments. The yarn 112 of the first warp forming the second row of the industrial textile 100 is configured to bind the yarns 131, 132, 133, 134 of the weft under two 131, 132 and over two yarns 133, 134 of the weft.

FIG. 1C illustrates a cross section of the yarns 131, 132, 133, 134 of the weft and the yarn 122 of the second warp in a machine direction in accordance with at least some embodiments. The yarn 122 of the second warp forming the second row of the industrial textile 100 is configured to bind the yarns 131, 132, 133, 134 of the weft under three 131, 132, 133 and over one yarn 134 of the weft.

FIG. 1D illustrates a cross section of yarns of a weft and a yarn of a first warp in a machine direction in accordance with at least some embodiments. The yarn 111 of the first warp forming the first row of the industrial textile 100 is configured to bind the yarns 131, 132, 133, 134 of the weft over two 131, 132 and under two yarns 133, 134 of the weft.

FIG. 1E illustrates a cross section of yarns of a weft and a yarn of a second warp in a machine direction in accordance with at least some embodiments. The yarn 121 of the second warp forming the first row of the industrial textile 100 is configured to bind the yarns 131, 132, 133, 134 of the weft over one yarn and under three yarns of the weft.

FIG. 2A illustrates a cross section of an industrial textile in a machine direction. The industrial textile 100 comprises the yarns 111, 112 of the first warp, the yarns 121, 122 of the second warp and the yarns 131, 132, 133, 134 of the weft. The yarns 111, 112 of the first warp are arranged above the yarns 121, 122 of the second warp. The yarn 111 of the first warp and the yarn 121 of the second warp are configured to form a first row of the industrial textile 100, and the yarn 112 of the first warp and the yarn 122 of the second warp are configured to form a second row of the industrial textile 100.

FIG. 2B illustrates a cross section of the yarns 131, 132, 133, 134 of the weft and the yarn 112 of a first warp in a machine direction in accordance with at least some embodiments. The yarn 112 of the first warp forming the second row of the industrial textile 100 is configured to bind the yarns 131, 132, 133, 134 of the weft over two 131, 132 and under two yarns 133, 134 of the weft.

FIG. 2C illustrates a cross section of the yarns 131, 132, 133, 134 of the weft and the yarn 122 of the second warp in a machine direction in accordance with at least some embodiments. The yarn 122 of the second warp forming the second row of the industrial textile 100 is configured to bind the yarns 131, 132, 133, 134 of the weft over one 131 and under three yarns 132, 133, 134 of the weft.

FIG. 2D illustrates a cross section of the yarns of the weft 131, 132, 133, 134 and the yarn of the first warp in a machine direction in accordance with at least some embodiments. The yarn 111 of the first warp forming the first row of the industrial textile 100 is configured to bind the yarns 131, 132, 133, 134 of the weft under two 131, 132 and over two yarns 133, 134 of the weft.

FIG. 2E illustrates a cross section of the yarns of the weft 131, 132, 133, 134 and the yarn 121 of the second warp in a machine direction in accordance with at least some embodiments. The yarn 121 of the second warp forming the first row of the industrial textile 100 is configured to bind the yarns 131, 132, 133, 134 of the weft under three yarns and over one yarn of the weft.

The industrial textile can comprise the yarns of the weft having two to four different diameters. Preferably, there are the yarns of the weft having two different diameters.

According to an embodiment, every second, third or fourth yarn of the weft on the first level L1 has a larger diameter than the other yarns of the weft on the first level L1. This enables a coarse structure on the first side of the industrial textile.

According to an embodiment, the yarns of the weft having smaller diameter are configured to alternate with the yarns of the weft having larger diameter on the second level L2.

According to an embodiment, the industrial textile 100 has one yarn of the weft having a larger diameter and one yarn of the weft having a smaller diameter in a pattern repeat on the first level. In addition, the industrial textile 100 has one yarn of the weft having a larger diameter and one yarn of the weft having a smaller diameter in a pattern repeat on the second level, one yarn of the weft having a smaller diameter and one yarn of the weft having a larger diameter in a pattern repeat on the second level, or every yarn of the weft on the second level has the same diameter, which diameter is smaller than the diameter of the larger yarns of the wefts on the first level. This enables a coarse structure on the first side and a relative smooth structure on the second side of the industrial textile.

According to an embodiment, the industrial textile 100 has one yarn of the weft having a larger diameter and two yarns of the weft having a smaller diameter in a pattern repeat on the first level. In addition, the industrial textile has one yarn of the weft having a smaller diameter, one yarn of the weft having a larger diameter and one yarn of the weft having a smaller diameter in a pattern repeat on the second level, or one yarn of the weft having a larger diameter and two yarns of the wefts having a smaller diameter in a pattern repeat on the second level. This enables a coarse structure on the first side and a relative smooth structure on the second side of the industrial textile.

According to an embodiment, the industrial textile 100 has one yarn of the weft having a larger diameter and three yarns of the weft having a smaller diameter in a pattern repeat on the first level. In addition, the industrial textile has one yarn of the weft having a smaller diameter, two yarns of the wefts having a larger diameter and one yarn of the weft having a smaller diameter in a pattern repeat on the second level. This enables a coarse structure on the first side and a relative smooth structure on the second side of the industrial textile.

According to an embodiment, the industrial textile 100 has one yarn of the weft having a larger diameter and one yarn of the weft having a smaller diameter in a pattern repeat on the first level. In addition, the industrial textile has one yarn of the weft having a smaller diameter, one yarn of the weft having a larger diameter and two yarns of the weft having smaller diameters in a pattern repeat on the second level. This enables a coarse structure on the first side and a relative smooth structure on the second side of the industrial textile.

FIGS. 3A to 3G illustrate sizes of yarns of a weft on a first level and a second level of an industrial textile in accordance with at least some embodiments. The yarns of the weft with a larger diameter alternate with the yarns of the weft with a smaller diameter in a pattern repeat.

FIG. 3A illustrates that every second yarn of the weft on the first level has a larger diameter than the other yarns of the weft on the first level. Thus, there is one yarn of the weft having a larger diameter and one yarn of the weft having a smaller diameter in a pattern repeat on the first level. Every second yarn of the weft on the second level has a larger diameter than the other yarns of the weft on the second level. Thus, there is one yarn of the weft having a larger diameter and one yarn of the weft having a smaller diameter in a pattern repeat on the second level.

FIG. 3B illustrates that every second yarn of the weft on the first level has a larger diameter than the other yarns of the wefts on the first level. Thus, there is one yarn of the weft having a larger diameter and one yarn of the weft having a smaller diameter in a pattern repeat on the first level. Every second yarn of the weft on the second level has a larger diameter than the other yarn of the wefts on the second level. Thus, there is one yarn of the weft having a smaller diameter and one yarn of the weft having a larger diameter in a pattern repeat on the second level.

FIG. 3C illustrates that every second yarn of the weft on the first level has a larger diameter than the other yarns of the weft on the first level. Thus, there is one yarn of the weft having a larger diameter and one yarn of the weft having a smaller diameter in a pattern repeat on the first level. Every yarn of the weft on the second level has the same diameter, which diameter is smaller than the diameter of the larger yarn of the wefts on the first level.

FIG. 3D illustrates that every third yarn of the weft on the first level has a larger diameter than the other yarns of the weft on the first level. Thus, there is one yarn of the weft having a larger diameter and two yarns of the wefts having smaller diameter in a pattern repeat on the first level. Every third yarn of the weft on the second level has a larger diameter than the other yarn of the wefts on the second level. Thus, there is one yarn of the weft having a smaller diameter, one yarn of the weft having a larger diameter and one yarn of the weft having a smaller diameter in a pattern repeat on the second level.

FIG. 3E illustrates that every third yarn of the weft on the first level has a larger diameter than the other yarns of the weft on the first level. Thus, there is one yarn of the weft having a larger diameter and two yarns of the wefts having a smaller diameter in a pattern repeat on the first level. Every third yarn of the weft on the second level has a larger diameter than the other yarn of the wefts on the second level. Thus, there is one yarn of the weft having a larger diameter and two yarns of the wefts having a smaller diameter in a pattern repeat on the second level.

FIG. 3F illustrates that every fourth yarn of the weft on the first level has a larger diameter than the other yarns of the weft on the first level. Thus, there is one yarn of the weft having a larger diameter and three yarns of the weft having a smaller diameter in a pattern repeat on the first level. There is one yarn of the weft having a smaller diameter, two yarns of the wefts having a larger diameter and one yarn of the weft having a smaller diameter in a pattern repeat on the second level.

FIG. 3G illustrates that every second yarn of the weft on the first level has a larger diameter than the other yarns of the weft on the first level. Thus, there is one yarn of the weft having a larger diameter and one yarn of the weft having a smaller diameter in a pattern repeat on the first level. Every fourth yarn of the weft on the second level has a larger diameter than the other yarn of the wefts on the second level. Thus, there is one yarn of the weft having a smaller diameter, one yarn of the weft having a larger diameter and two yarns of the weft having smaller diameters in a pattern repeat on the second level.

The diameters of the yarns of the weft having the larger diameter are 0.2 mm greater than the diameters of the yarns of the weft having the smaller diameter. Thus, the diameters of the yarns of the weft differ from each other to form a textured textile surface.

The diameters of the yarns of the weft having smaller diameters can be for example, under 0.6 mm, preferably 0.4-0.6 mm, more preferably 0.5 mm.

The diameters of the yarns of the weft having larger diameters can be for example, over 0.6 mm, preferably 0.6-0.9 mm, more preferably 0.7 mm.

FIG. 4 illustrates a surface view of an industrial textile in accordance with at least some embodiments. The yarns 111, 112 of the first warp next to each other are arranged in such a manner that when a coincidentally selected warp yarn 111 is under the weft yarns, the warp yarn 112 next to the coincidentally selected warp 111 yarn is above the weft yarns. Furthermore, the yarns 121, 122 of the second warp next to each other are arranged in such a manner that when a coincidentally selected warp yarn 121 is under the weft yarn, the warp yarn 122 next to the coincidentally selected warp 121 yarn is above the weft yarn.

Figure 5:
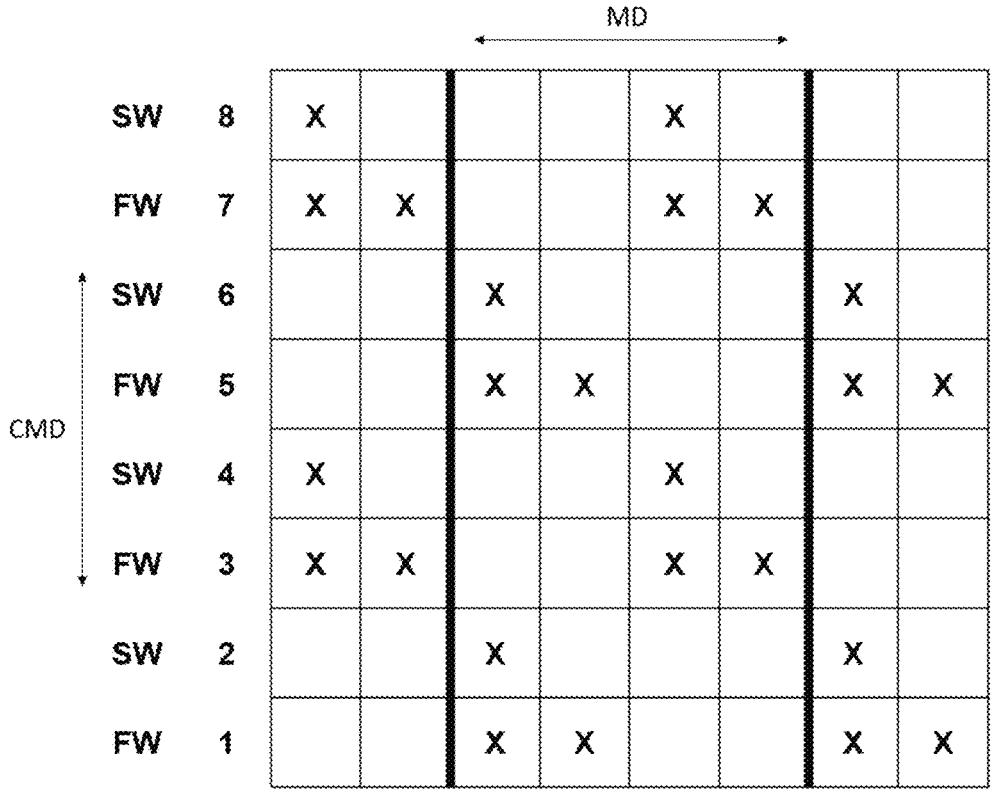
FIG. 5 illustrates a weaving pattern of an industrial textile in accordance with at least some embodiments of the present invention.

FIG. 5 illustrates a weaving pattern of an industrial textile in accordance with at least some embodiments. FW refers to a first warp of the industrial textile and SW refers to a second warp of the industrial textile. X denotes that the yarn of the first warp of the second warp is over a yarn of a weft. Numbers 1 to 8 refers to the warps 1 to 8. A coincidentally selected yarn of the first warp and the yarn of the second warp are arranged in such a manner that when the yarn of the first warp binds the yarns of the weft under two, the yarn of the second warp binds the yarns of the weft under two. In addition, a yarn of the first warp next to the coincidentally selected warp yarn of the first warp and a yarn of the second warp next to the coincidentally selected warp yarn are arranged in such manner that when the yarn of the first warp binds the yarns of the weft over two, the yarn of the second warp binds the yarns of the weft over one and under one.

Referring to FIG. 5, diameters of the yarns of the weft which the warp number 1 binds can be for example, 0.50 mm. Diameters of the yarns of the weft which the warp number 2 binds can be for example, 0.50 mm, diameters of the yarns of the weft which the warp number 3 bind can be for example, 0.70 mm, diameters of the yarns of the weft which the warp number 4 bind can be for example, 0.50 mm, diameters of the yarns of the weft which the warp number 5 bind can be for example, 0.70 mm, diameters of the yarns of the weft which the warp number 6 bind can be for example, 0.50 mm, diameters of the yarns of the weft which the warp number 7 bind can be for example, 0.50 mm, and diameters of the yarns of the weft which the warp number 8 bind can be for example, 0.70 mm. This enables a coarse textured structure on the first side of the industrial textile.

Figure 6:
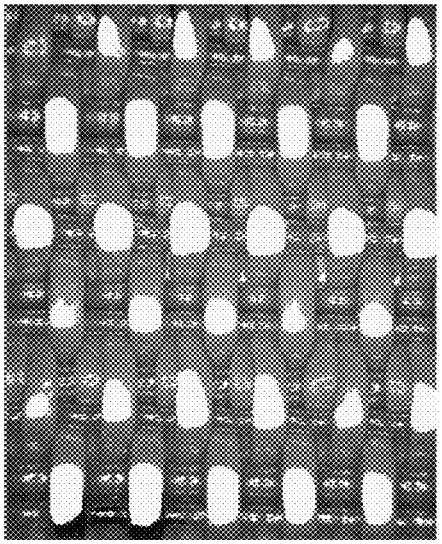
FIG. 6 illustrates a contact area of an industrial textile in accordance with at least some embodiments of the present invention.

FIG. 6 illustrates a contact area of an industrial textile in accordance with at least some embodiments. There is higher peaks (white areas) and lower valleys in a thickness direction of the industrial textile.

According to an embodiment, the contact area can be under 20%.

The contact area is measured by a method comprising providing a sample of the industrial textile having a length of 130 mm in the machine direction and a width of 20 mm in the cross-machine direction, polishing the paper-side of the sample by removing 0.12 mm in a thickness direction of the sample, photographing the sample by a microscope camera, calibrating magnification by a calibration ruler, imaging the calibration ruler and the polished surface of the sample with the calibrated magnification, and measuring percentage of the contact area by an image processing software. An image area is 12 mm in the cross-machine direction.

According to an embodiment, the first machine direction yarns 111, 112 of the first warp are flat yarns.

According to an embodiment, the second machine direction yarns 121, 122 of the second warp are flat yarns.

According to an embodiment, the cross-machine direction yarns 131, 132, 133, 134 of the weft are round yarns. However, also oval yarns can be used.

Figure 7:
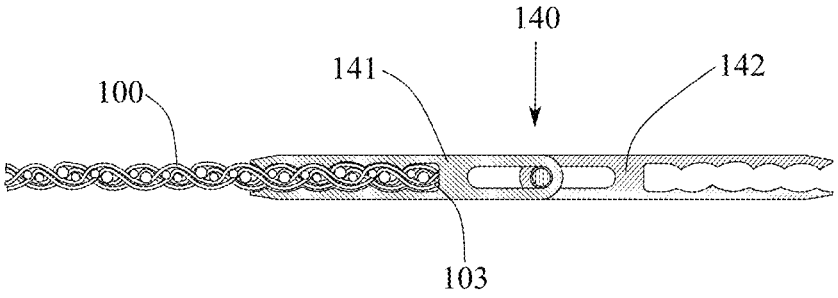
FIG. 7 illustrates a seam element in accordance with at least some embodiments of the present invention.

FIG. 7 illustrates a seam element 140 in accordance with at least some embodiments. The industrial textile 100 comprises a first edge 103 and a second edge 104, which the first edge 103 and the second edge 104 are configured to be connected together by the seam element 140. The seam element comprises a first part 141 connected to the first edge 103 and a second part 142 connected to the second edge 104. The granular surface of the industrial textile enables better grip of the seam element on the textile surface. Thus, strength of the seam is higher.

FIG. 7 illustrates that the first part 141 and the second part 142 of the seam element 140 have inner surfaces, which are arranged in the contact with the industrial textile 100. The inner surface of the first part 141 and the inner surface of the second part 142 of the seam element 140 are shaped to correspond to a surface texture of the industrial textile 100. The granular surface of the industrial textile with the shaped inner surface of the parts of the seam element enables better grip of the seam element on the textile surface. Thus, the strength of the seam is higher, because the seam element does not slide out of its place during the use of the industrial textile.

Alternatively, the inner surface of the first part 141 and the inner surface of the second part 142 of the seam element can comprise teeth configured to be attached to the industrial textile 100. The teeth can be configured to be attached to the lower valleys of the industrial textile.

According to an embodiment, the first machine direction yarns 111, 112, the second machine direction yarns 121, 122 and the cross-machine direction yarns 131, 132, 133, 134 can consist essentially of a virgin or recycled polyethylene terephthalate (PET), polyphenylene sulfide (PPS), polyketone (PK), thermoplastic aliphatic polyketone (PK), polyether ether ketone (PEEK), polyamide (PA), polypropylene (PP), polyvinylidene difluoride (PVDF), polyolefin (PO), polyester (PES), polyphenylene sulfone (PPSU), polyurethane (PU), polyphenylene ether (PPE), polyphenylene ketone, polyphenylene etherketone (PEEK), liquid crystalline polymer, aliphatic polyketone, and/or biopolymer.

According to an embodiment, the industrial textile 100 is used as a conveyor fabric, a dryer fabric or a filter fabric.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "an embodiment" means that a particular feature, structure, or characteristic described in connection with the embodiment is included in at least one embodiment of the present invention. Thus, appearances of the phrase "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verb "to comprise" is used in this document as open limitations that neither exclude nor require the existence of also un-recited features. The features recited in depending claims are mutually freely combinable unless otherwise explicitly stated. Furthermore, it is to be understood that the use of "a" or "an", i.e., a singular form, throughout this document does not exclude a plurality.

I claim:

1. An industrial textile having a machine direction and a cross-machine direction, and a first surface and a second surface, the industrial textile comprising:

a double warp, comprising:

a first warp comprising first machine direction yarns, and a second warp comprising second machine direction yarns, wherein the yarns of the first warp are arranged above the yarns of the second warp, a weft comprising cross-machine direction yarns, wherein the yarns of the first warp and the yarns of the weft are bonded to each other according to a first predetermined pattern;

wherein the yarns of the second warp and the yarns of the weft are bonded to each other according to a second predetermined pattern; and wherein the first predetermined pattern and the second predetermined pattern form a textile structure, which comprises the yarns of the weft on a first level and the yarns of the weft on a second level in a thickness direction of the industrial textile;

wherein yarns of the weft having a smaller diameter are configured to alternate with yarns of the weft having a larger diameter on the first level, and wherein the industrial textile has a contact area of less than 20%.

2. The industrial fabric of claim 1 wherein said contact area is measured by a method comprising providing a sample of the industrial textile, polishing a paper-side of the sample by removing 0.12 mm in a thickness direction of the sample, photographing the sample by a microscope camera, calibrating magnification by a calibration ruler, imaging the calibration ruler and the polished surface of the sample with the calibrated magnification, and measuring the percentage of the contact area by an image processing software.

3. The industrial textile of claim 1, wherein every second, third or fourth yarn of the weft on the first level has a larger diameter than the other yarns of the weft on the first level.

4. The industrial textile of claim 1, wherein the on the second level the yarns of the weft comprise second level yarns of a smaller diameter and second level yarns of a larger diameter, and wherein said the second level yarns of smaller diameter are configured to alternate with the second level yarns of larger diameter.

5. The industrial textile of claim 4, wherein the industrial textile has:

on the first level one yarn of the weft having a larger diameter and one yarn of the weft having a smaller diameter in a pattern repeat; and on the second level, one yarn of the weft having a larger diameter and one yarn of the weft having a smaller diameter in a pattern repeat; or on the second level, one yarn of the weft having a smaller diameter and one yarn of the weft having larger diameter in a pattern repeat.

6. The industrial textile of claim 4, which industrial textile has:

one yarn of the weft having a larger diameter and two yarns of the weft having a smaller diameter in a pattern repeat on the first level; and one yarn of the weft having a smaller diameter, one yarn of the weft having a larger diameter and one yarn of the weft having a smaller diameter in a pattern repeat on the second level; or one yarn of the weft having a larger diameter and two yarns of the weft having a smaller diameter in a pattern repeat on the second level.

7. The industrial textile of claim 4, which industrial textile has one yarn of the weft having a larger diameter and three yarns of the weft having a smaller diameter in a pattern repeat on the first level, and one yarn of the weft having a smaller diameter, two yarns of the wefts having larger diameter and one yarn of the weft having a smaller diameter in a pattern repeat on the second level.

8. The industrial textile of claim 4, which industrial textile has one yarn of the weft having a larger diameter and one yarn of the weft having a smaller diameter in a pattern repeat on the first level; and one yarn of the weft having a smaller diameter, one yarn of the weft having a larger diameter and two yarns of the weft having smaller diameters in a pattern repeat on the second level.

9. The industrial textile of claim 1, wherein the diameters of the yarns of the weft having a larger diameter are 0.2 mm greater in diameter than the diameters of the yarns of the weft having a smaller diameter.

10. The industrial textile of claim 1, wherein in the first predetermined pattern, the yarns of the first warp are configured to bind the yarns of the weft under two and over two yarns of the weft.

11. The industrial textile of claim 1, wherein in the second predetermined pattern, the yarns of the second warp are configured to bond the yarns of the weft under three yarns and over one yarn of the weft.

12. The industrial textile of claim 1, wherein the yarns of the first warp next to each other are arranged in such a manner that when a coincidentally selected warp yarn is under the weft yarns, the warp yarn next to the coincidentally selected warp yarn is above the weft yarns.

13. The industrial textile of claim 1, wherein the yarns of the second warp next to each other are arranged in such a manner that when a coincidentally selected warp yarn is under the weft yarn, the warp yarn next to the coincidentally selected warp yarn is above the weft yarn.

14. The industrial textile of claim 1, wherein:

a coincidentally selected yarn of the first warp and the yarn of the second warp are arranged in such a manner that when the yarn of the first warp binds the yarns of the weft under two, the yarn of the second warp binds the yarns of the weft under two, and a yarn of the first warp next to the coincidentally selected warp yarn of the first warp and a yarn of the second warp next to the coincidentally selected warp yarn are arranged in such manner that when the yarn of the first warp binds the yarns of the weft over two, the yarn of the second warp binds the yarns of the weft over one and under one.

15. The industrial textile of claim 1, wherein the industrial textile comprises a first edge and a second edge, and wherein the first edge and the second edge are configured to be connected together by a seam element, which comprises a first part connected to the first edge and a second part connected to the second edge.

16. The industrial textile of claim 15, wherein an inner surface of the first part and an inner surface of the second part of the seam element are shaped to correspond to a surface texture of the industrial textile.

17. The industrial textile of claim 15, wherein the inner surface of the first part and the inner surface of the second part of the seam element comprise teeth configured to be attached to the industrial textile.

18. The industrial textile of claim 1 wherein the industrial textile is a conveyor fabric, a dryer fabric or a filter fabric.

19. An industrial textile having a machine direction and a cross-machine direction, and a first surface and a second surface, the industrial textile being a conveyor fabric, a dryer fabric or a filter fabric, the industrial textile comprising:

a double warp, comprising:

a first warp comprising first machine direction yarns; and a second warp comprising second machine direction yarns, wherein the yarns of the first warp are arranged above the yarns of the second warp;

a weft comprising cross-machine direction yarns, wherein the yarns of the first warp and the yarns of the weft are bonded to each other according to a first predetermined pattern;

wherein the yarns of the second warp and the yarns of the weft are bonded to each other according to a second predetermined pattern; and wherein the first predetermined pattern and the second predetermined pattern form a textile structure, which comprises the yarns of the weft on a first level and the yarns of the weft on a second level in a thickness direction of the industrial textile; and wherein yarns of the weft having a smaller diameter are configured to alternate with yarns of the weft having a larger diameter on the first level, and wherein the industrial textile has a contact area of less than 20%, wherein the contact area is measured by a method comprising providing a sample of the industrial textile, polishing a paper side of the sample by removing 0.12 mm in a thickness direction of the sample, photographing the sample, calibrating magnification by a calibration ruler, imaging the calibration ruler and the polished surface of the sample with the calibrated magnification, and measuring the percentage of the contact area.

* * * * *